US008800600B2

(12) United States Patent
Huang

(10) Patent No.: US 8,800,600 B2
(45) Date of Patent: Aug. 12, 2014

(54) COMBINED HYDRAULIC INTEGRATED CONTROL VALVE BLOCK SYSTEM

(75) Inventor: Renhao Huang, Shanghai (CN)

(73) Assignee: Shanghai Renhao Hydraulic Technology Co., Ltd., Shanghai (CN)

( * ) Notice: Subject to any disclaimer, the term of this patent is extended or adjusted under 35 U.S.C. 154(b) by 220 days.

(21) Appl. No.: 13/203,767

(22) PCT Filed: Mar. 4, 2010

(86) PCT No.: PCT/CN2010/000260

§ 371 (c)(1),
(2), (4) Date: Oct. 12, 2011

(87) PCT Pub. No.: WO2010/099699

PCT Pub. Date: Sep. 10, 2010

(65) Prior Publication Data

US 2012/0024406 A1 Feb. 2, 2012

(30) Foreign Application Priority Data

Mar. 6, 2009 (CN) ..... 2009 1 0047242

(51) Int. Cl.
*F15B 13/02* (2006.01)
*F15B 13/04* (2006.01)

(52) U.S. Cl.
USPC ..... 137/884; 137/596.14

(58) Field of Classification Search
USPC ..... 137/269, 271, 625.2–625.69, 884
See application file for complete search history.

(56) References Cited

U.S. PATENT DOCUMENTS

| | | | | | |
|---|---|---|---|---|---|
| 3,589,387 | A | * | 6/1971 | Raymond | 137/261 |
| 3,915,194 | A | * | 10/1975 | Friedrich | 137/884 |
| 4,359,064 | A | * | 11/1982 | Kimble | 137/269 |
| 4,711,267 | A | * | 12/1987 | Schwelm | 137/596.15 |
| 4,723,576 | A | * | 2/1988 | Raymond | 137/884 |
| 5,975,134 | A | * | 11/1999 | Schwelm | 137/596.15 |

* cited by examiner

*Primary Examiner* — John Fox
*Assistant Examiner* — Seth W Mackay-Smith
(74) *Attorney, Agent, or Firm* — John P. White; Cooper & Dunham LLP

(57) ABSTRACT

A combined hydraulic integrated control valve block system includes pilot control valve group, control valve subassembly, combination of valve blocks which are connected with external part for installing the pilot control valve group and the control valve subassembly. The pilot control valve group includes multiple pilot control valves and the standard installation surface for the pilot valve is formed on the valve block. The control valve subassembly includes multiple two-way cartridge valve control subassemblies. The valve block is formed with one or two external installation surfaces, the inner side of which has P, T, A and B main channels and multiple pilot control channels.

23 Claims, 11 Drawing Sheets

COMBINED HYDRAULIC INTEGRATED CONTROL VALVE BLOCK SYSTEM

CROSS-REFERENCE TO RELATED APPLICATIONS

This application is a §371 national stage of PCT International Application No. PCT/CN2010/000260, filed Mar. 4, 2010, claiming priority of Chinese Patent Application No. CN 200910047242.5, filed Mar. 6, 2009, the contents of all of which are hereby incorporated by reference into this application.

TECHNICAL FIELD

The present invention relates to a combined hydraulic integrated control valve block system, more specially, involves a modular configurable open hydraulic integrated control valve block system.

BACKGROUND

Hydraulic control valves and systems, which are widely applied to hydraulic drive and control systems, are used to control direction, pressure and flow of fluid and significantly influence various areas of industrial and mobile equipment, in which hydraulic transmission systems are used.

Traditionally mainstream hydraulic control valves are various types of so-called "plated connection" hydraulic control valves adopting international standards (such as 4 ports directional control valves and sandwich valves using the standard installation surface conformed to ISO4401/CETOP, 2 ports pressure control valves using standard installation surface conformed to ISO6264/5781, flow control valves using standard installation surface conformed to ISO6263, and so on).

From the principle of technology, this kind of products can be called "single element" products. The so-called valve systems currently are combinations of various types of valve circuits and systems with "single element" valve products according to the control requirements, based on experience (multi-functional control circuits and systems of, such as directional, pressure, flow and combination thereof). In so many valve circuits/loops and systems, the combined loop based on 4 ports directional control valves, that is, so-called "4-way loop", is one of the most important and common loops. These 4-way loops with 4 ports directional valves, kinds of throttles and flow valves (usually with check/one direction elements), pressure valves (usually with check elements), almost takes up more than half of all of the circuits.

The schematic of traditional four-way hydraulic circuit in FIG. 1 shows a typical complicated four-way circuit based on 4 ports directional control valves. Because of history, "single element" valves only have one function, but have different internal and external structures, they not only are seriously disperse in function, structure and form, but also, with development of the technology they are used inconveniently.

By the judgment of "the principle of minimal fluid resistance" in hydraulic loop design proposed by "Hydraulic Resistance Theory", these traditional valve circuits and systems consisted of "single element" valves, especially the most representative 4-way circuits consisted of 4 port direction control valves, have many defects and unreasonable structures.

In addition, from the technical aspect, the most traditional "single element" hydraulic circuits perform the so called "manifold block(plate)" "valve block", or "integrated block") pattern based on installation surfaces, according to the requirement of application, manufacturing and installation. When hydraulic circuits and systems have to change or partly change designs or frames, this kind of circuits and manifold blocks (valve blocks or integrated blocks), not only related valve elements, valve circuits, and design and layout of its system, but also the design of manifold block (valve blocks or integrated blocks) have to be changed, which means that the connection, installation and process of the system have to be changed. So, any change in circuits will cause correspondingly a change in all the chain of supplement. The changes will, not only increase costs, postpone the time limit, require many new designs and drawing documents and increase possibilities of errors, but also make the management complicated. Then, this will make the management can not fit the rapid development of technical environment, and is bad for the mode of modern product development, advanced manufacturing and fine management.

Actually, the widely used connections and integrated patterns based on installation surface try to improve the performance of module and configuration by using traditional stack and connection block modular integrated pattern. The efforts have made some progress in components and circuits, but, in general of smaller size, especially in middle size between 10 mm and 32 mm, did not obviously overcome above mentioned defects.

BRIEF SUMMERY OF THE INVENTION

It is an object according to the present invention to overall realign and replace all kinds of control circuits and combinations including circuits based on 4 ports directional control valves, which are currently the mainstream in the field of industrial and mobile equipments, by use of new technical solutions, according to modular, configurable and open mode in the modern control.

To solve the above problems, the technical solution of the invention is as follows:

A combined hydraulic integrated control valve block system comprise a pilot control valve group, a control valve subassembly and a valve block body which is connected with an external part for installing the pilot control valve group and the control valve subassembly, wherein the pilot control valve group consists of a multiple pilot control valves, and the said control valve subassembly consists of multiple 2-way cartridge control valve assemblies, the installation surfaces of the pilot control valve group on the valve block body conform to the standard and the valve block body has four main channels, P, T, A and B, multiple pilot control channels and at least one or two external installation surface(s).

Furthermore, in the present invention the combined hydraulic integrated control valve block systems contain combinations of same channel size or different channel size valve blocks in the manner of horizontal integration, vertical integration or mixture of these integrations.

Furthermore, 4-way integrated control valve block system, according to the present invention, comprising a pilot control valve group, four 2-way cartridge control subassemblies, a valve block body and connection components between the external portion and internal portions thereof, has four main channels, P, T, A and B, multiple pilot control channels, multiple internal installation surfaces and at least one or at least two external installation surfaces.

The 4-way integrated control valve block system can be combined as follows:

Furthermore, according to the present invention, the 4-way integrated control valve block system is horizontally integrated 4-way integrated control valve block system, which has two external installation surfaces. The valve block body in the 4-way integrated control valve block system is a polyhedral casting based on cuboid, which uses high strength and high performance of black metal or nonferrous metal by machine process after casting. The top of the valve block body is provided an installation boss (projecting), and boss-type steps are formed by the boss and two parallel finishing flat surfaces (refinedly processed flat surfaces). The protruding installation surface of the boss is used to install two pilot control valve groups. The flat surfaces in parallel with the boss surface may be used to install two flanged control cover plates with two 2-way cartridge valve control assemblies.

The finishing installation surface in the side of the front surface of the valve block body may be used to install two 2 way cartridge valve control assemblies.

The left and right finishing installation surfaces of the valve block body are provided main channels, P, T ports, control channels Pc, ports Tc and connection holes used to install bolts. The left and right finishing installation surfaces, the front installation surface used to install two control subassemblies and the boss-type step surfaces including the installation boss and two finishing installation surfaces are all internal installation surfaces.

The bottom and back surfaces of the said valve block body, both of which may be used as external installation surfaces, are also used as out ports of the main channels A and B, and connection installation surfaces, or, are used to install various pressure compensation assemblies and so on.

Furthermore, according to the present invention, the 4-way integrated control valve block system is a vertically integrated 4-way integrated control valve block system, which has one external installation surface. The valve block body in the 4-way integrated control valve block system is a polyhedral casting based on cuboid. The front of the valve block body is provided an installation boss, and the protruding installation surface of the boss is used to install two pilot control valve groups.

The left and right finishing installation surfaces of the valve block body are used to install multiple flanged control cover plates with 2-way cartridge valve control assembly.

The top and bottom finishing installation surfaces of the valve block body are provided main channels, P and T ports, control channels Pc, ports Tc and connection holes used to install bolts.

The back installation surface of the valve block body, which is external installation surface, is used as out ports of main channels A, B, and connection installation surfaces, assistant installation surfaces, or other functions.

The 4-way integrated control valve block system also may be a single 4-way integrated control valve block system, and the valve block body in the said single 4-way integrated control valve block system is a polyhedral casting based on cuboid. The top or front of the valve block body is provided a boss for installation of components, which can comprise boss-type stepped surfaces constituted by two parallel finishing surfaces. The protruding installation surface of the boss is used to install two pilot control valve groups, and the flat surface in parallel with boss surface is used to install two flanged control cover plates with 2-way cartridge control assembly, or can also be used to connect other elements in advance.

The valve block body is made of forging or profile materials, all of channels in which are finished by machine processing.

The single 4-way integrated control valve block system is a horizontally integrated 4-way integrated control valve block system, which at least has two external installation surfaces. The valve block body in the single 4-way integrated control valve block system is of a polyhedral casting based on cuboid. The top of the valve block body is a boss for installation, and one finishing installation surface of the protruding installation surface of the boss is used to install two pilot control valve groups, and another finishing installation surface in parallel with said protruding installation surface of the boss in the stepped surfaces of the boss is used to install two flanged control cover plates with 2-way cartridge control valve assembly. The bottom or left and right side surfaces of the valve block body may be used by high-pressure input port P, low-pressure output port T of main channels and connection surfaces for pilot control channel. The back installation surfaces of the valve block body are provided with high-pressure output ports A and B, used as channels or connection holes to install various pressure compensation subassemblies and so on.

The single 4-way integrated control valve block system is vertically integrated 4-way integrated control valve block system, which at least has one external installation surface. The valve block body in the single 4-way integrated control valve block system is a polyhedral casting based on cuboid. The front of the valve block body is a boss for installation, and a finishing installation surface of the protruding portion of the boss is used to install two pilot control valve groups. The left and right installation surfaces of the valve block body are used to install two flanged control cover plates with 2-way cartridge control assembly respectively and symmetrically. The bottom surface of the valve block body is used as high-pressure input port P, low-pressure output port T of main channels and connections for pilot control Channels. The back of the valve block body is used as high-pressure output ports A, B of main channels or connections to install various pressure compensation assemblies and so on.

The valve block body is made of forging or profile materials, and the channels and surfaces in which are all processed by machine.

Furthermore, according to the present invention, 3-way integrated control valve block system, consisting of a pilot control valve group, two 2-way cartridge control subassemblies, and a valve block body and the components for connection between with internal and external portions of the valve block body, has three main channels, P, T, A or B, and multiple pilot control channels, multiple internal installation surfaces and at least one or two external installation surfaces.

The 3-way integrated control valve block system is a horizontally integrated 3-way integrated control valve block system, which has two external installation surfaces. The left and right finishing installation surfaces of the valve block body of the system are provided main channels ports P and T, control channels Pc and Xc and connection holes used to install bolts.

The 3-way integrated control valve block system is a vertically integrated 3-way integrated control valve block system, which has one external installation surface. The left and right finishing installation surfaces of the valve block body of the said system are provided main channels ports P and T, control channel ports Pc and Xc and connection holes used to install bolts.

Furthermore, according to the present invention, an input end integrated control valve block system includes a pilot control valve group, control vale assemblies and a valve block body. The pilot control valve group includes two pilot control valves; the control valve assembly includes two 2-way cartridge control assemblies; and the pilot control valve group is mounted on flanged control cover plates with standard installation surfaces. The valve block body is a polyhedral casting based on cuboid, and has main channels, P, T, and multiple pilot control channels and at multiple external and internal installation surfaces.

The input end integrated control valve block system is a horizontally integrated input end integrated control valve block system, which has at least two external installation surfaces. The top and front surfaces of the system's valve block body used to install a flanged control cover plate with a 2-way cartridge control assembly. On the right side surfaces of the valve block body input and output ports of main channels P and T, pilot control channel ports and connection holes used to install bolts are provided. On the bottom and left installation surfaces of the valve block body main channels high-pressure input port P, low-pressure output port T and external control channels for pilot control are provided.

Through using the principle and new elements of the present invention, in complicated loops, systems and combinations it has almost completely avoided a large number of functions and structures overlap in traditional loops using "sigle element", significantly avoided the intensive use of control valves, and provided a more reasonable and compact integration approach or method.

DETAILED DESCRIPTION OF PREFERRED EMBODIMENTS

Figure 1:
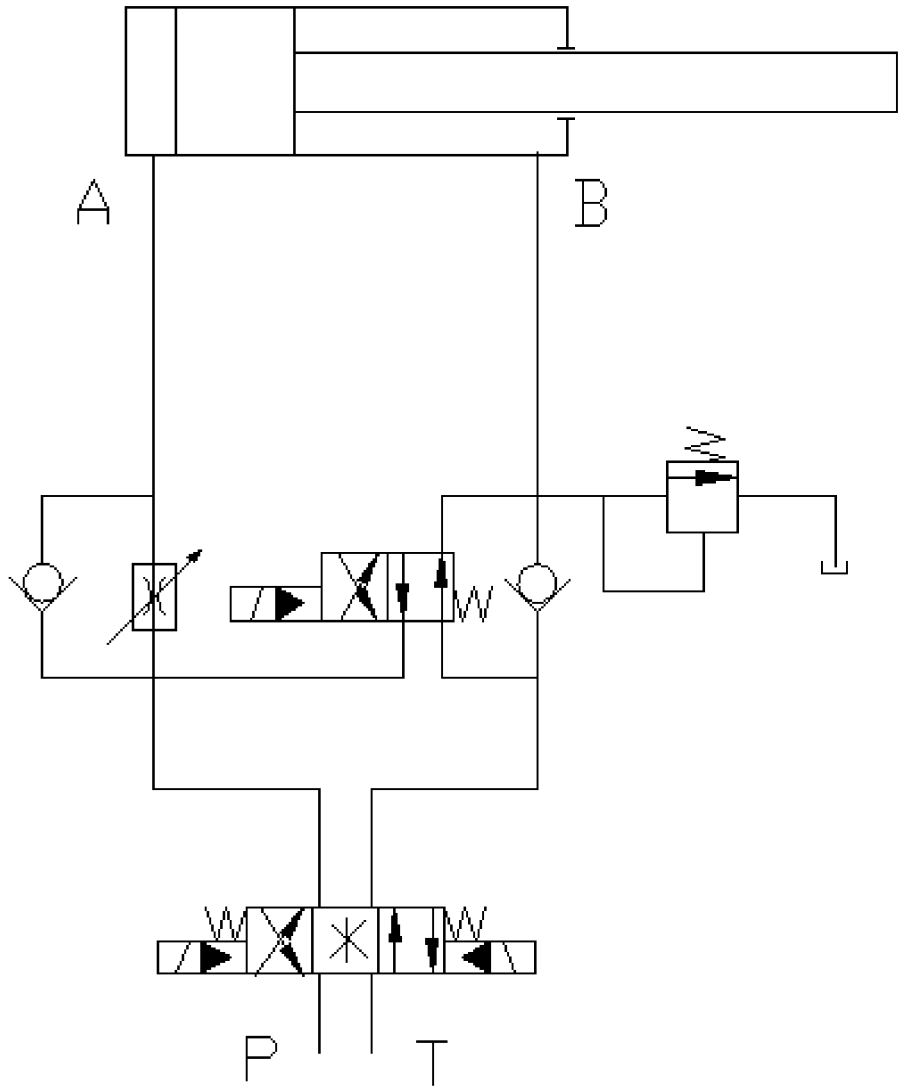
FIG. 1 is a schematic of traditional four-way hydraulic circuit.

In order to easily understand the technical means, characteristics, functions and effects of the present invention, now the present invention is described and explained in details referring to drawings to explain.

The present invention involves one or one group, two or two groups pilot control valves or valve groups, which use standard installation surfaces, especially, conforming to ISO4401-02/03, ISO4401-02 and CETOP RP121H-4.2-4-P02, or, threaded cartridge pilot control valves or valve groups, which use standard installation holes conforming to ISO7789; two or four 2-way slide type cartridge valve control assemblies, that are called "single control hydraulic resistance", which are especially designed and optimized and use installation holes and conforming to ISO7368/DIN2434, or threaded cartridge valve control assemblies which are also especially designed and optimized; may be used to install pilot control valves or assemblies, 2-way cartridge valve subassemblies, input/output fittings, seal, accessories and so on. The valve block body can be used alone or can be horizontally or vertically integrated when the channels in each blocks can be connected reasonably. The valve block body also can be called "integrated block body". The combined hydraulic integrated control valve block system according to the present invention usually consists of the above mentioned three main parts. These combined 4-way or 3-way integrated control valve blocks, using new technology principle and modular method, can constitute a large-scale integrated control structure by combining with other assistant or secondary blocks described hereinafter.

Generally, the valve block system, equipped with one or one group, two or two group pilot control valves, four 2-way cartridge valves control or assemblies and other accessories, having four main ports 041(P), 042(T), 043(A) and 044(B) and one or two external installation surfaces (see FIGS. 3 and 4), is called "4-way integrated control valve block system". The valve block, equipped with one or two pilot control valves or assemblies, two 2-way cartridge valves or assemblies and other accessories, having three main channels 041 (P), 042(T) and 043(A), is called 3-way integrated control valve block system (see FIG. 7). The structure of 3-way integrated control valve block system can be referred as to in FIG. 8. In all hydraulic integrated control valve block systems, the 4-way integrated control valve block system, which has four ports, is the most important and commonly used, so the valve block in the 4-way integrated control valve block system is the most typical and basic.

In the horizontally integrated 4-way integrated control valve block system 4001 (see FIGS. 3 and 13) and the vertically integrated 4-way integrated control valve block system 4002 (see FIGS. 4 and 14), the valve block body 401 (see FIG. 13) and 402 (see FIG. 14) are very creative and unique. They are polyhedral castings based on cuboids, which use high strength and high performance of black metal or nonferrous metal processed after casting. For different requirements, they can also be made of forging or profile after processed. The valve block bodies have many uniquely designed and optimized installation surfaces, having different installation and connection elements. The valve block body 401 in FIGS. 3 and 13 and the valve block body 402 in FIGS. 4 and 14 are typical 4-way integrated control valve blocks, which respectively has one or two external installation surfaces.

Figure 11:
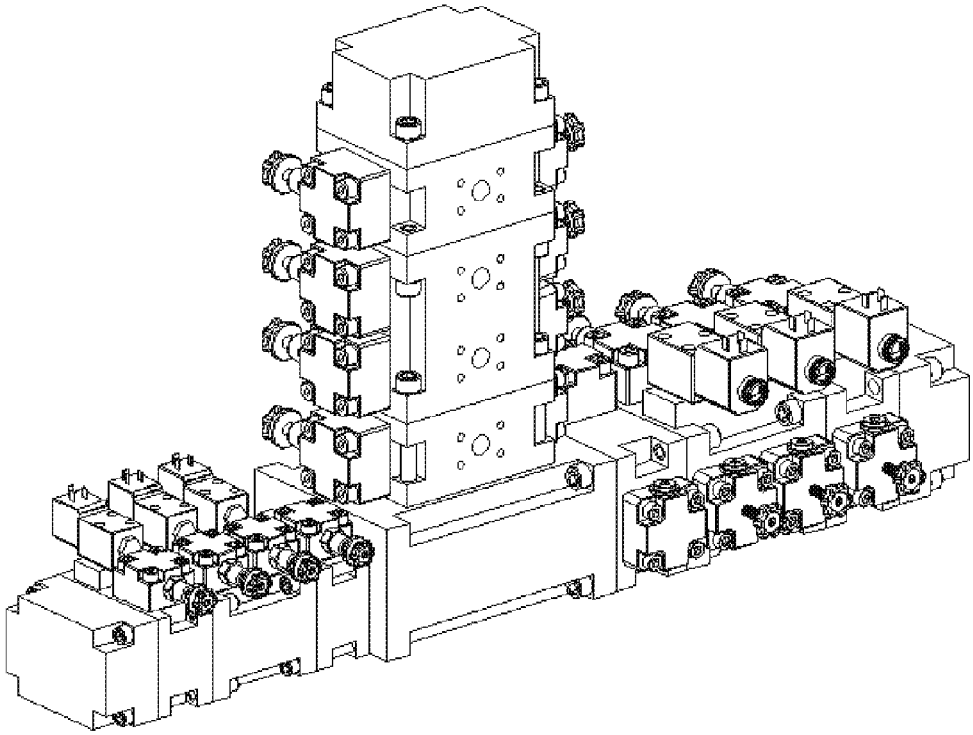
FIG. 11 is a structural schematic of integrated or complicated integrated (horizontally integrated and vertically integrated) control valve block system according to the present invention according to the present invention in different sizes.
Figure 12:
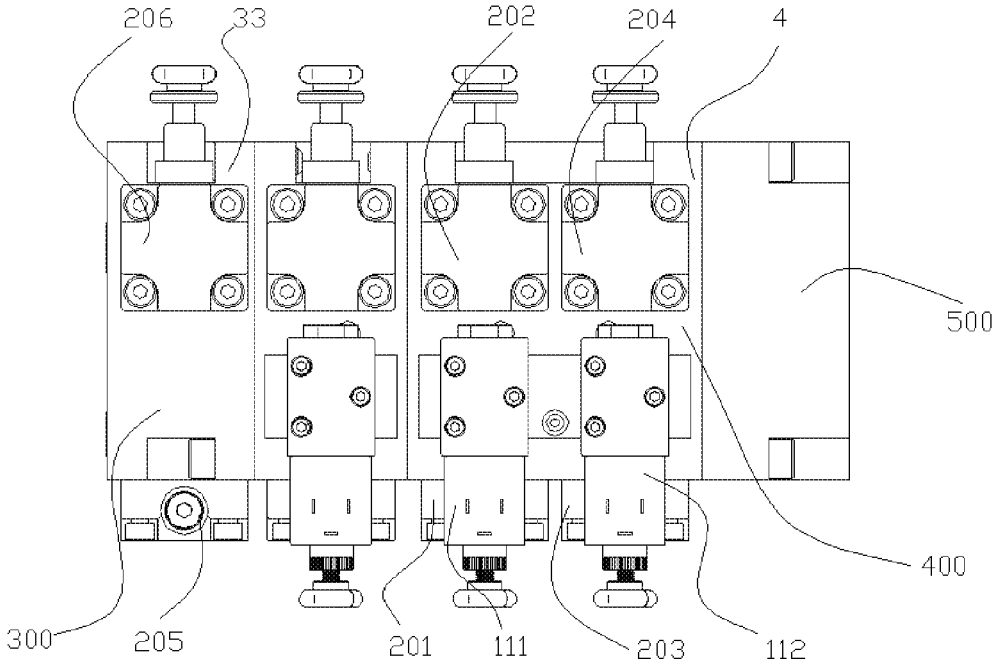
FIG. 12 is a structural schematic of a single body 4-way integrated control valve block system according to the present invention.

In fact, the basic structure of the above two valve block bodies can be replaceable, also can be slightly different. The two shown horizontally and vertically as FIGS. 13 and 14, also can have some modifications and be shown vertically and horizontally. The unique form, is very good for acquiring very rich and various large-scale monoblock integrations (such as that FIG. 11 is a structural schematic of different sizes integrated or complicated integrated (horizontally integrated and vertically integrated) control valve block system according to the present invention), and very flexible and various single or single unit monoblock integrations and combinations (such as that FIG. 12 is a structural schematic of a single 4-way integrated control valve block system according to the present invention.).

Figure 13:
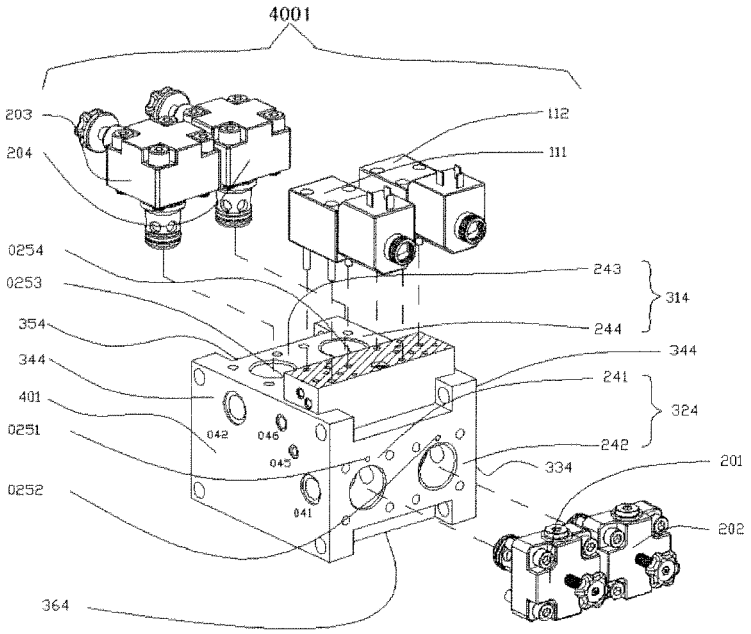
FIG. 13 is a disassembled structural schematic of FIG. 3.
Figure 14:
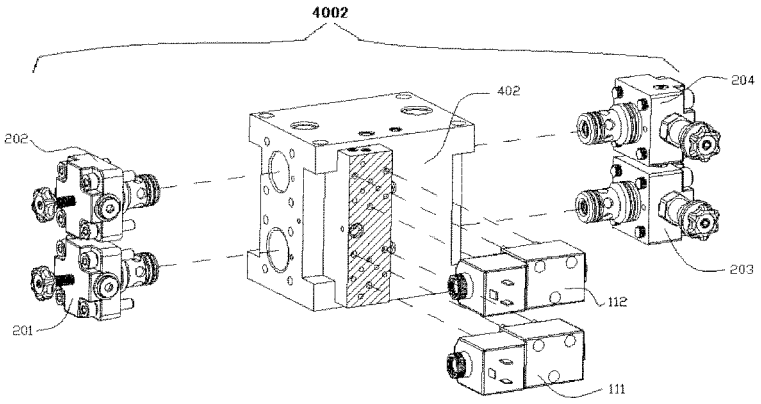
FIG. 14 is a disassembled structural schematic of FIG. 4.

The valve block body 401 in FIG. 13 and 402 in FIG. 14 are unique polyhedral based on a cuboids, one side surface of which has an installation boss.

Setting the horizontally integrated 4-way integrated control valve block system in FIG. 13 as an example. The surface 314 in FIG. 13 is actually a boss (step) surface and consists of two parallel finishing surfaces which are used to install two or two groups pilot control valves 111 and 112. Moreover, on the boss surface and the sides (mainly, front, back, left and right sides) of it important and critical installation holes, which are small sizes and large numbers, are formed by drilling or processing, to install pilot control valves and kinds of micro-pilot control components and accessories. The installation boss can compactly and parallelly arrange two 4 ports directional valves or two threaded cartridge valves, which use standard installation surfaces conforming to ISO4401-02/03 and CETOP RP121H-4.2-4-P02 (preferably, ISO4401-02 and CETOP RP121H-4.2-4-P02). The space is enough for the two valves, and they can be independent each other. The non boss finishing surfaces in surface 314 can also be an installation surface. The installation surfaces 243 and 244 are used to install the two 2-way cartridge valve subassemblies 203, 204. The stepped surface 314 consisting of the installation surfaces 243 and 244 compacts and miniaturize the 4-way integrated control valve block system, and the structure is a unique design. The surface 324 in FIG. 13 is the front surface of the valve block body. On this surface installation connection surfaces 241, 242 are provided, which have two mounting holes conforming to ISO7368 or flanged cover plates smaller than those under ISO7368, which are the same as said installation surfaces 243 and 244. They are used to install 2-way cartridge valves 201, 202 conforming to ISO7368 and flanged cover plate size of which are smaller than that regulated in ISO7368.

According to the above technical principles, it can arrange four pilot control ports 0251, 0252, 0253 and 0254 on surfaces 314, 324, which are respectively corresponding to control ports in the flanged cover plate. The four pilot control holes 0251, 0252, 0253 and 0254 are used to connect pilot control valves 111, 112, and 2-way cartridge valves 201, 202, 203, 204 following some special rules so that the system can conveniently acquire pre-control of main stages of 2-way cartridge valves 201, 202, 203, 204, and set up connections among ports P, T, A and B orderly and regularly according to requirements of control, then construct a "main stage basic power circuit" to achieve expectant functions.

The valve block body 401 in FIG. 13 can be changed a little to install threaded cartridge valves and can acquire functions as needed by combining threaded cartridge pilot valves.

Referring to FIG. 13, the surfaces 344, 334 are the left and right surfaces of the valve block body, and are used to fully connect main channels 041(P), 042(T), and control channels 045(Pc), 046(Tc) (usually externally control), and are used as connection installation surfaces in the same size or different sizes and installation surfaces for stack integration valve block bodies. When in the same size connections or stack integration, the layout and location of ports in the two left and right surfaces are almost the same, and can be connected correctly. The only difference is that in relevant position around holes of channels 041(P), 042(T), 045(Pc) and 046 (Tc) on one surface in left or right side, slots should be arranged for seal. In order to reliably connect and seal, four screw holes are provided for connection on the surfaces 344, 334. These holes can be used for connection between layers as either "short bolt" or "long bolt". That is, the four screw holes are designed to be optional to fulfill different requirements. This will be advantageous for various kinds of combinations, and can acquire better effectiveness and quality of connection.

In addition, near the middle portion of the two surfaces a space is especially reserved for holes for tighten screw, which are used to enhance the tightness of connection.

The above mentioned four installation surfaces are called "internal installation surfaces", which are used for internal configurable connections.

The surfaces 354, 364 in FIG. 13 are the back and bottom surfaces of the valve block body. On the two surfaces output ports A, B are arranged. The two surfaces can be flanged, threaded or other forms of installation surfaces, depending on flow channel layout and configurable requirements. Near the ports enough space has been provided to dispose and install accessories or nameplate if it needed.

Figure 5:
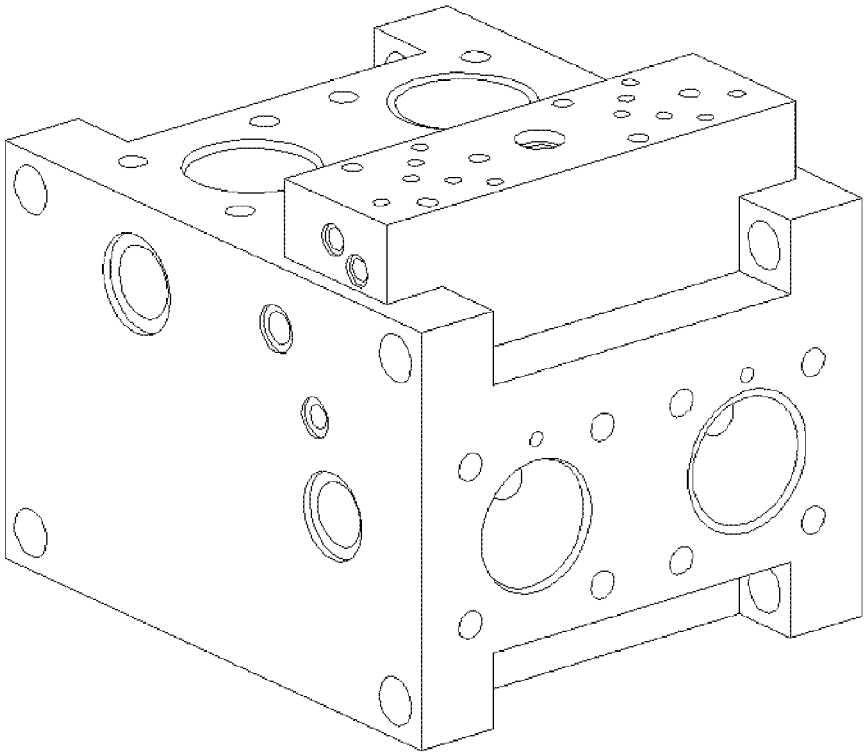
FIG. 5 is a structural schematic of valve block body in the horizontally integrated 4-way integrated control valve block system in FIG. 4.
Figure 6:
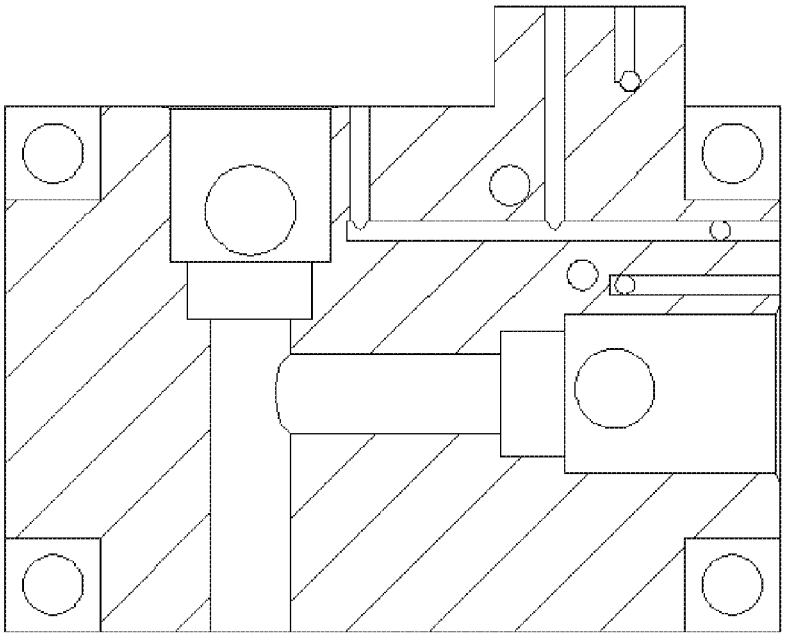
FIG. 6 is a cross section of the valve block body in FIG. 5.

From channel layout and the elements' positions in section FIGS. 5 and 6, it can be seen that the main channels P, T, and control channels $P_C$, $T_C$ both go throughout the valve block body. These channels are in parallel with each other, that is, "straight hole type", when valve blocks of the same size are integrated. When different sizes valve blocks are integrated, that is, the channels have to be changed. When main channels P, T, are casting, flow channels, except the mouths of holes (orifices), do not need to be processed (machined). When they are forging or profile, the main flow channels need to be processed.

Referring to FIG. 13, the main channel 041 used to connect 2-way cartridge valves 201, 202 and the main channel 042 used to connect 2-way cartridge valves 203, 204 and controlling the resistance of oil output are usually in the status of "straight channels". However, the connection between output ports for 2-way cartridge valves 201, 203 and output ports for 2-way cartridge valves 202, 204 can have different structures depending on types of "basic power circuit".

On the bottom surface 364, as shown in figures, of the valve block body an installation surface for output ports A, B is provided as needed, besides screw hole for connection. On the back surface 354 the output ports A, B can also be arranged. That is, the valve block body in FIG. 13 has two external installation surfaces for different requirements.

The way of connection in FIG. 13 is an optimal and better means. It can ensure main control requirements, also can provide various new control functions (applied in the circumstances of, such as, leak-free or differential loops and flow regeneration functional or various inlet and outlet check throttle control functional 4-way circuits). The valve block body has two external installation surfaces 354, 364 and is very good for layout and direction selection for input and output channels.

FIG. 14 shows another optimal and better embodiment, which is vertically integrated 4-way integrated control valve block system. The most of structure in FIG. 13 is the same as that in FIG. 14, but a little difference. In FIG. 13, the connections between the main channel P and any of main stage of 2-way cartridge valve 201, control subassembly of 2-way cartridge valves 203, and the connections between the main channel T and any of the main stage of 2-way cartridge valve 202 and control subassembly of 2-way cartridge valve 204 in FIG. 13 are different from those in FIG. 14. Although in FIG. 14 it uses the same "basic power circuit" and main stage combination in FIG. 13, the layout of the main channels, etc., is different. But, a the boss still has installation surfaces to install pilot control valves 111, 112. The differences are that on the not-installation boss, the installation holes for 2-way cartridge valve control subassemblies are no longer provided. So the valve block body has just one useful external installation surface on the back surface of the valve block body.

According to the present invention in FIGS. 13 and 14 enough installation space is provided on the output port on the external installation surface of the valve block body to install other functional units or be used for hydraulic control valve block based on a flange connection in order to meet complicated requirements.

In above mentioned integrated control valve block system, the valve block bodies can be obtained by machining from forging, profile polyhex. The layout of all channels can be machined. The boss can directly be obtained by machining or by adding assistant pilot control and bolt connection.

Figure 7:
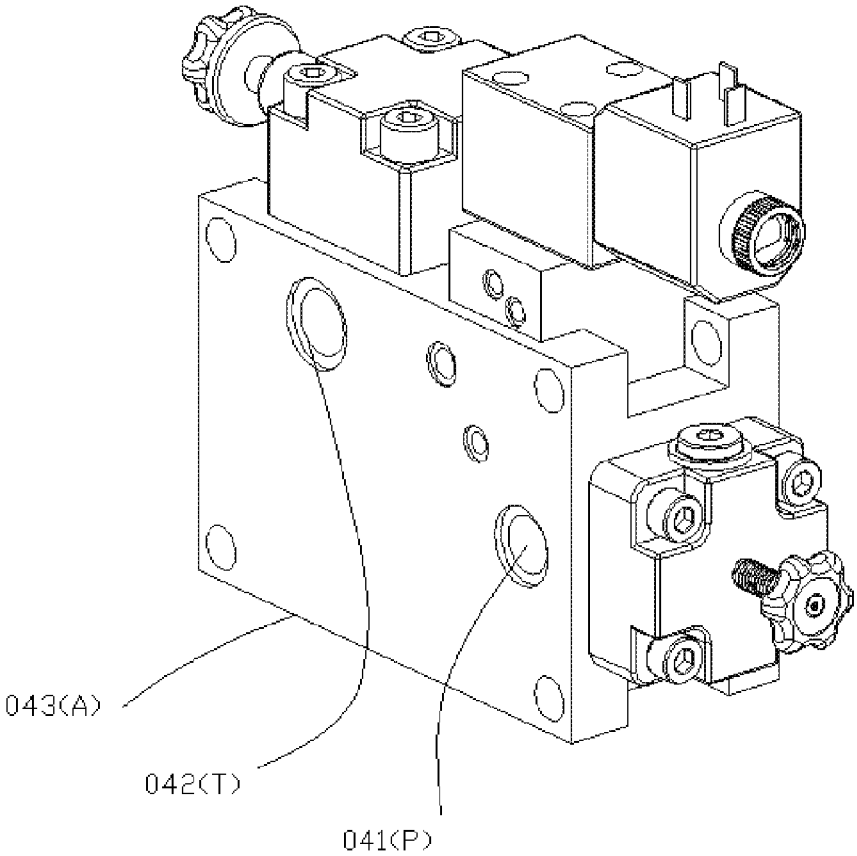
FIG. 7 is a structural schematic of horizontally integrated 3-way integrated control valve block system according to the present invention.
Figure 8:
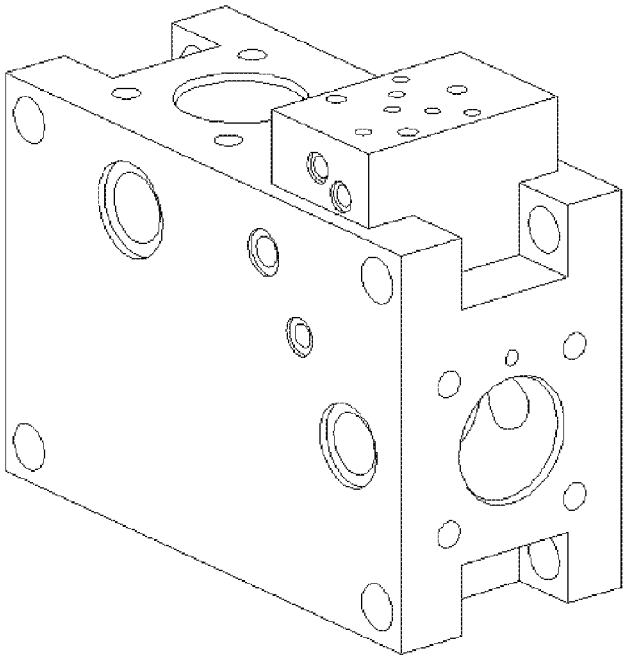
FIG. 8 is a structural schematic of valve block body in the horizontally integrated 3-way integrated control valve block system in FIG. 7.
Figure 15:
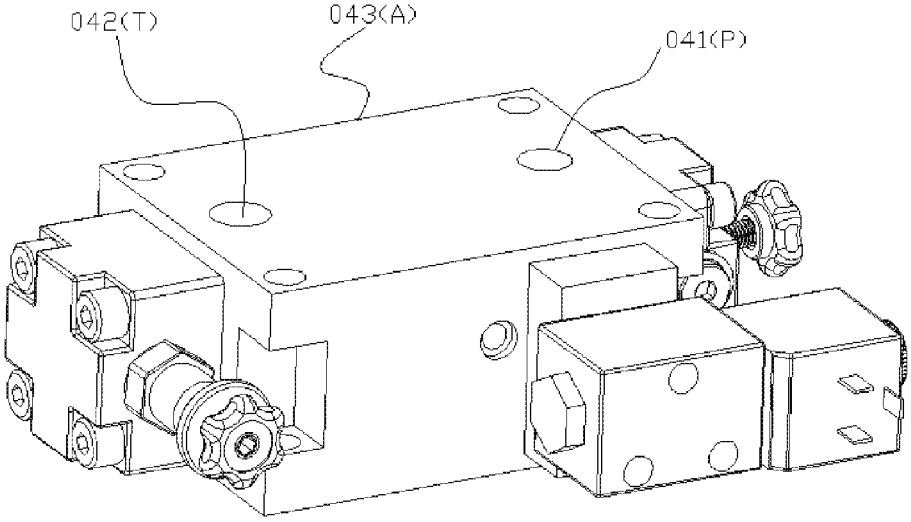
FIG. 15 is a structural schematic of vertically integrated 3-way integrated control valve block system according to the present invention.

In FIGS. 7 and 15 is the 3-way integrated control valve block system. The basic type of the 3-way integrated control valve block system is similar to the 4-way integrated control valve block system. It is a simplification of the 4-way integrated control valve block system. On the valve block body one group pilot control subassemblies and a 2-way cartridge valve assembly are arranged. The valve block body has three main channels P, T and A(B), and one or two external installation surfaces. The 3-way integrated control valve blocks can also be fabricated in similar ways. Similarly, the connection of methods or manners of channels 041(P), 042(T) and 043 (A) can be changed by above mentioned or other preferable manners.

Figure 10:
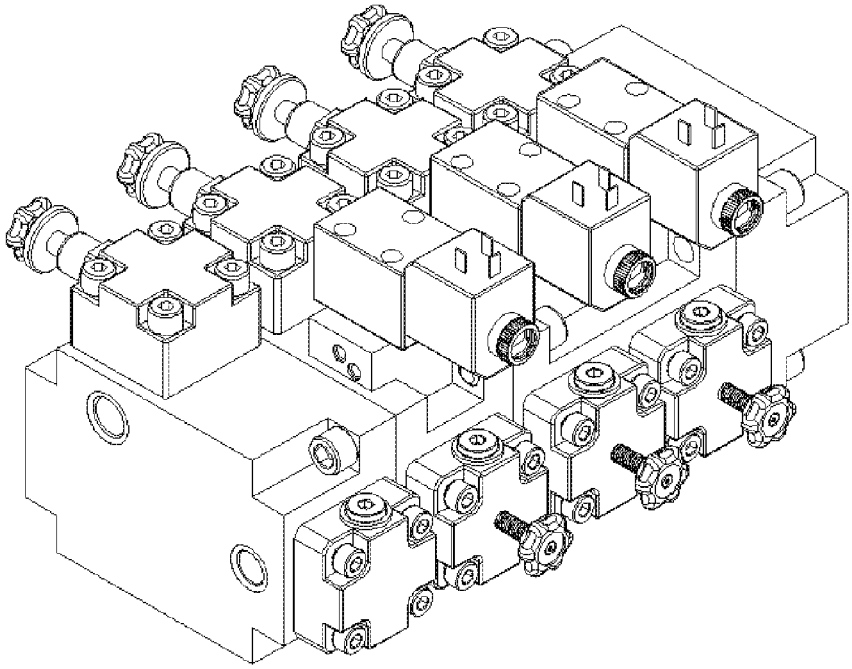
FIG. 10 is a structural schematic of horizontally integrated connection of combined integrated control valve block system according to the present invention.
Figure 19:
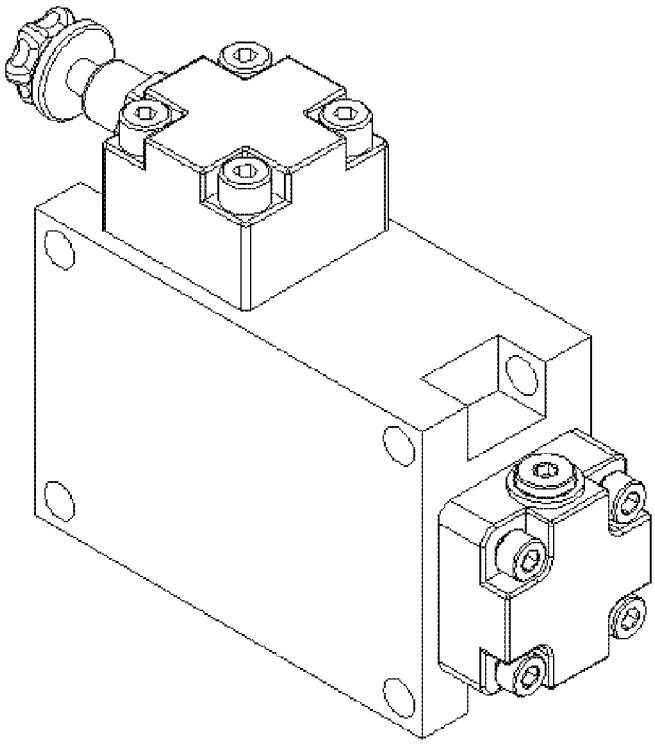
FIG. 19 is a structural schematic of an input integrated control valve block system according to the present invention.
Figure 20:
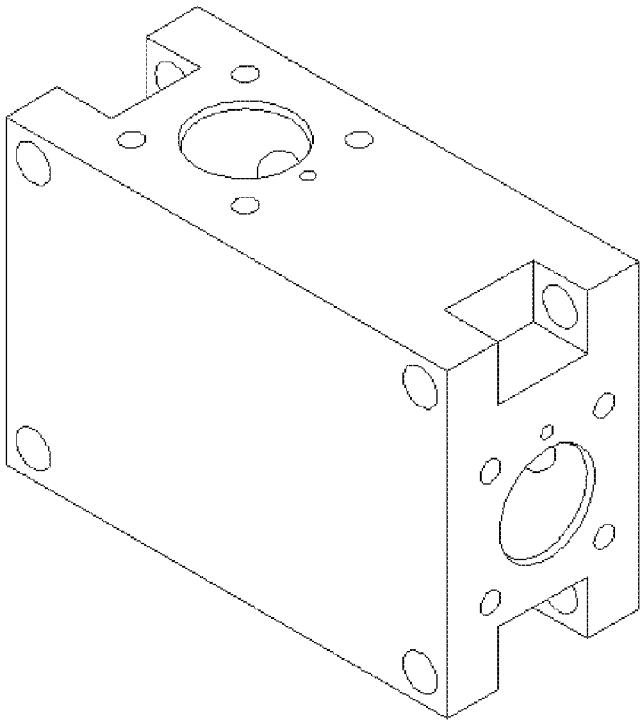
FIG. 20 is a structural schematic of valve block body in the input integrated control valve block system in FIG. 19.

Based on the same principle and technique, the input end integrated control valve block system can be seen in FIG. 19, and the valve block of the system can be seen in FIG. 20. Combined additional functional integrated control valve block is used to add additional function and secondary control function. The typical structure can be seen in FIG. 10.

Many kinds of patterns and various functional combined 4-way integrated control valve block systems and combined 3-way integrated control valve block systems mainly consist of above mentioned pilot control subassemblies, 2-way cartridge valve subassemblies, 4-way integrated control valve blocks and 3-way integrated control valve blocks. All these systems can be added input hydraulic integrated control valve blocks, additionally functional control blocks and terminal blocks and so on to constitute large scale combined hydraulic integrated control valve block systems. In general, these systems can satisfy all kinds of control requirements and can replace traditional combinations of large number of 4-way, 3-way control circuits and control systems or assemblies including 4-way, 3-way control circuits. In all hydraulic integrated control valve blocks, the combined 4-way hydraulic integrated control valve blocks are the most common used and typical blocks.

FIG. 11 is a structural schematic of same or different size integration (both horizontally integrated and vertically integrated) control valve block system according to the present invention.

Figure 2:
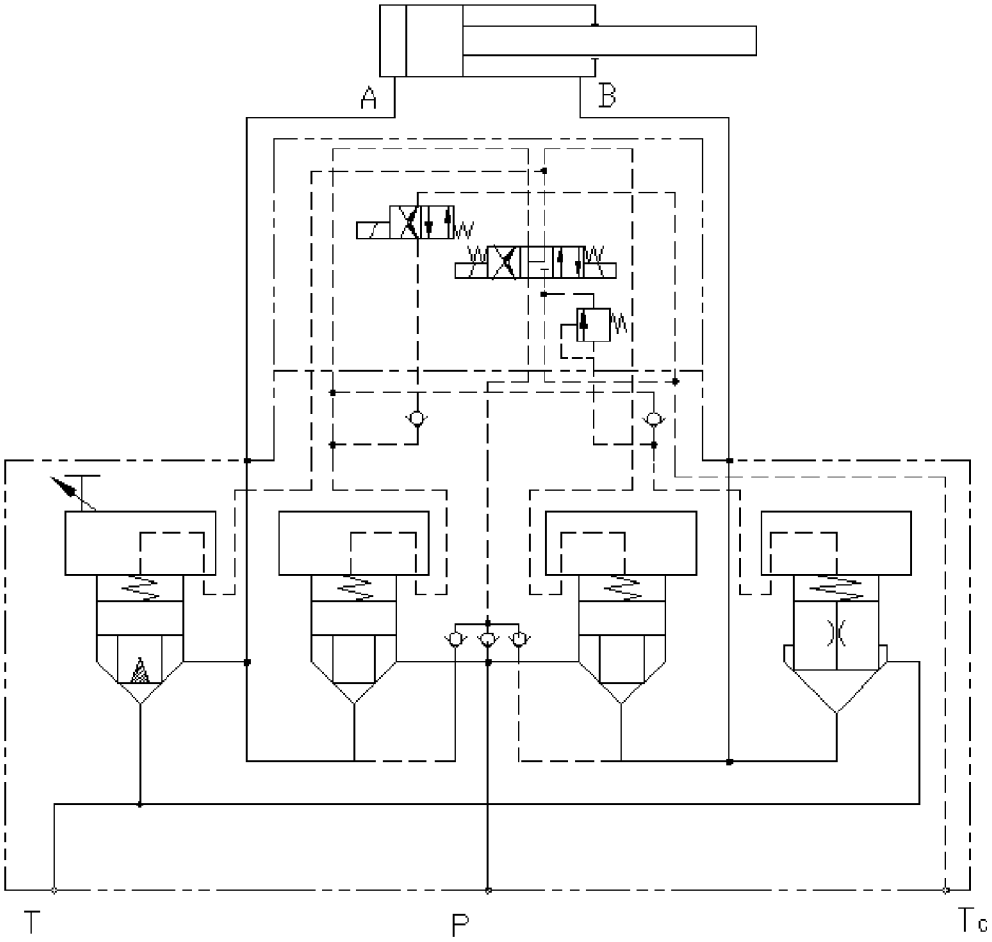
FIG. 2 is a schematic of four-way hydraulic circuit which uses 2-way cartridge valve subassemblies.
Figure 3:
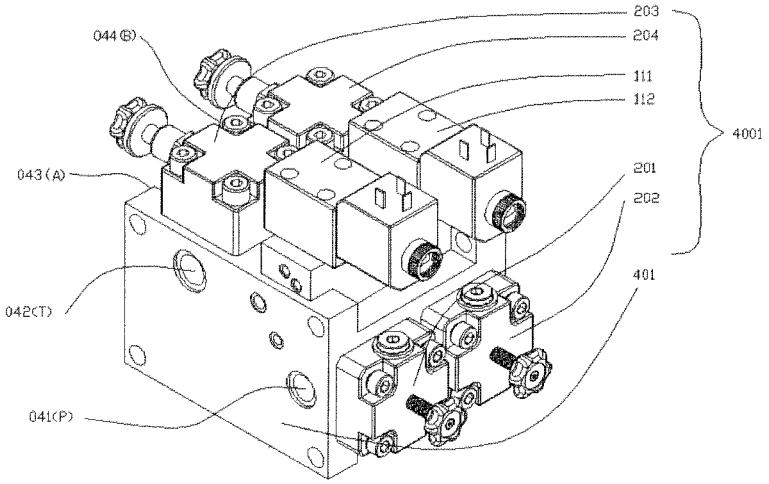
FIG. 3 is a structural schematic of horizontally integrated 4-way integrated control valve block system according to the present invention.
Figure 4:
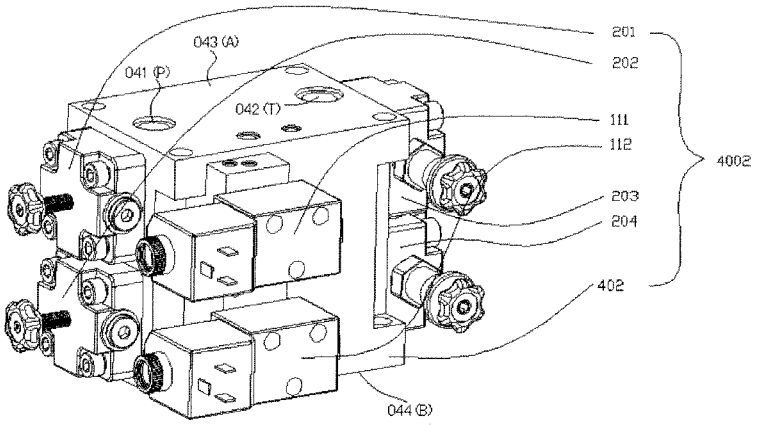
FIG. 4 is a structural schematic of vertically integrated 4-way integrated control valve block system according to the present invention.
Figure 16:
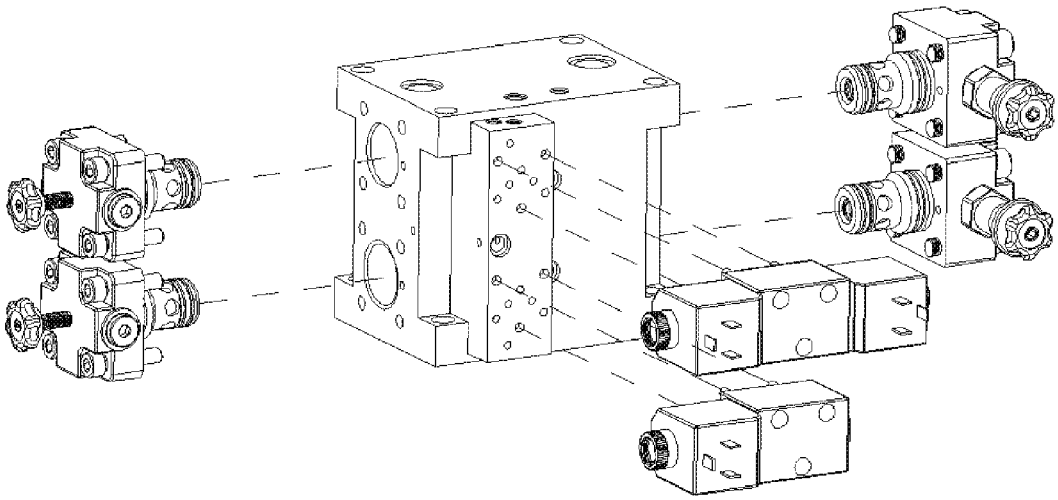
FIG. 16 is a disassembled structural schematic of 4-way hydraulic integrated control block system with additional back pressure and throttle control of such complicated control differential and flow regeneration function.

All above combined integration control valve blocks are widely used in removable hydraulic control and other industrial controls, such as plastics processing, hydraulic press-packing, metallurgy machine and various plane movement cylinders (steel push devices in metallurgy machines, mold set movement in machining tool), two 4/2 pilot solenoid valves and standard 2-way cartridge control subassemblies in FIGS. 3 and 4 can be used to conveniently configure or fabricate various functional 4/3 and 4/4 electro-hydraulic valves and circuits/loops. According to FIG. 2's loop schematic, the embodiment has a 4/2(3/2) pilot solenoid valve, a 4/3 pilot solenoid valve, four 2-way cartridge valve subassemblies and a 4-way valve block, thus, various kinds of combined 4-way integrated control valve block systems and circuits can conveniently be configured or set up, which have many different functions and can satisfy different requirements. FIG. 16 is a disassembled structural schematic of 4-way hydraulic integrated control block which can conveniently obtained complicated controls, such as, additional back pressure throttle, differential and flow regeneration function, etc., and can flexibly achieve differential driving opening or closing injection molding machine, and fast pre-pressure or pre-load for injection molding machine of differential drive, rapidly removing mold for forging machine, and rapid horizontal movement of steel pushing machine. If this kind of hydraulic loop uses traditional single components to combine a system, the design of the loop will be complicated and be in trouble, especially in middle or more than flow. The structure of the traditional loop will be huge and the relevant cost will increase.

Figure 9:
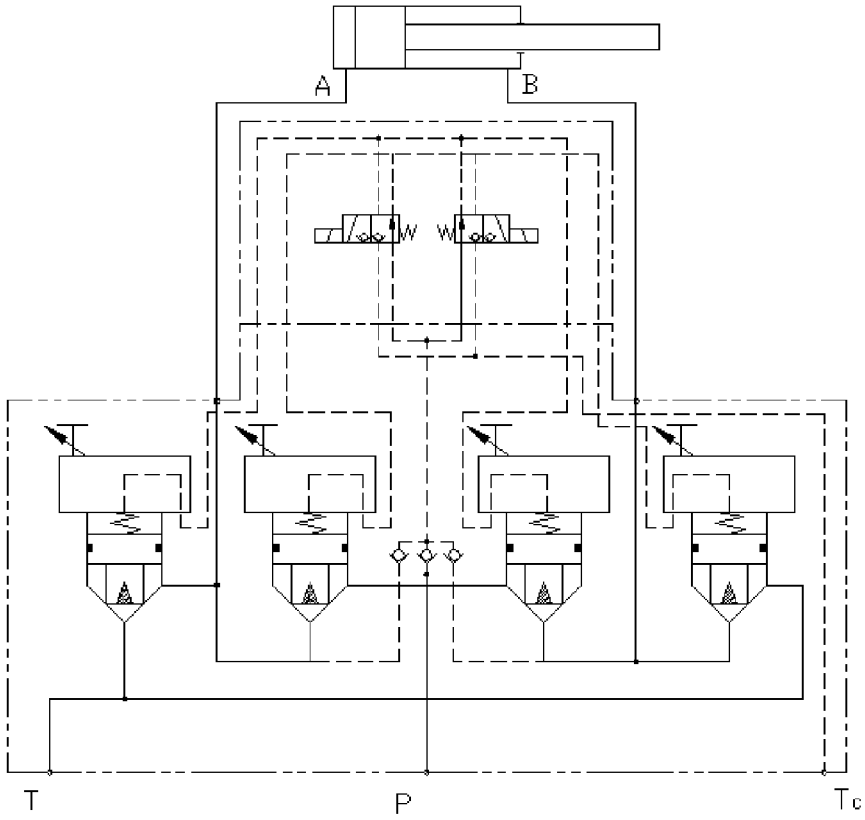
FIG. 9 is a schematic of leak-free four-way hydraulic circuit according to the present invention which uses 2-way cartridge valve subassemblies.
Figure 17:
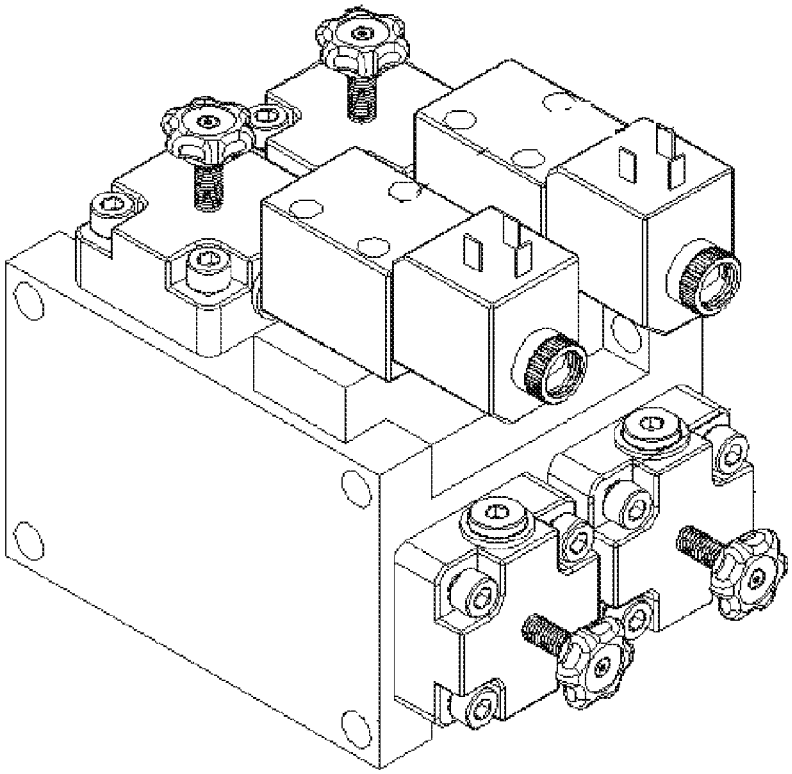
FIG. 17 is a structural schematic of a single 4-way hydraulic control block system with various inlet and outlet check throttle control function according to the present invention.
Figure 18:
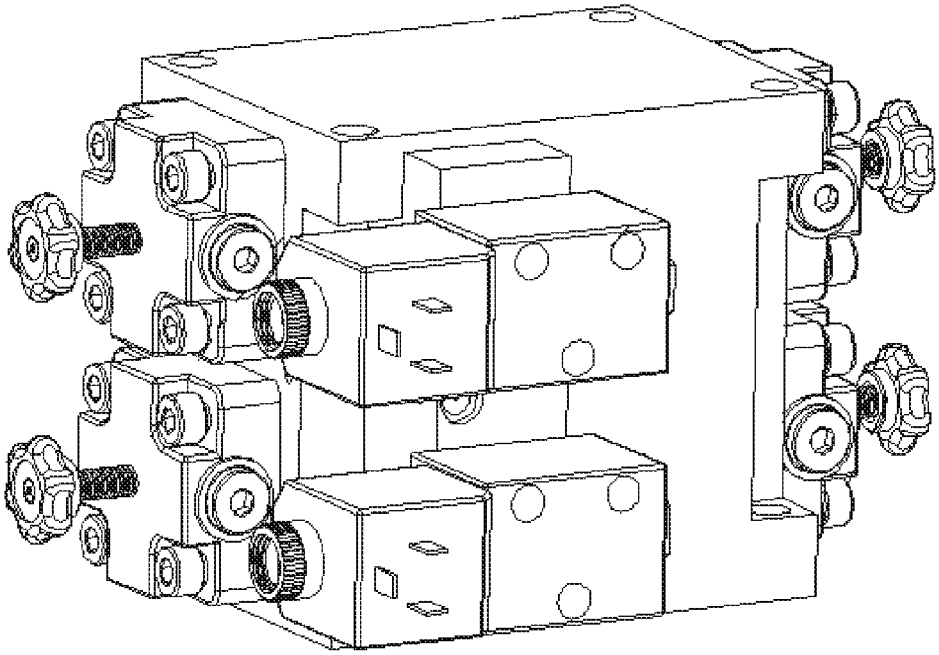
FIG. 18 is a structural schematic of another single 4-way hydraulic control block system with various inlet and outlet check throttle control function according to the present invention.

In addition, according to the loop schematic in FIG. 9 and on the basis of FIGS. 3 and 4, it can conveniently get about tens kinds of 4/3 combined 4-way integrated control valve blocks of single way throttle valve control loop consisting of traditional "single components" by changing main stage of 2-way cartridge valves 201, 202, configuration of 2-way cartridge valve control subassemblies 203, 204, and by using flanged cover plates 221, 222, 223, 224 with trip lever (adjustment bar). They can be applied in necessary oil inlet and outlet throttle in metallurgy roller in a various hydraulic systems. FIGS. 17 and 18 are diagrams of combined hydraulic control valve system adopting this kind of combination mode.

Similarly, from 2-way cartridge control valve subassemblies with different pressure control functional assemblies a three position four way loop (3/4 loop) which can have directional control, throttle control, pressure control functions and so on can conveniently be obtained, for example, this is commonly used in the downstream hydraulic control. FIG. 16 is a typical structure. The structure is similar to any other combined 4-way integrated control valve block systems, except a little difference on configuration of pilot control valves.

After using new components and technical principles, it has almost completely avoided the repeat of large number of functions and structures due to wide use of single component combined loops, and significantly decreased a large number of throttle valves and pressure control valves with check components. According to hydraulic resistance theory, it has actually followed the principle of minimal fluid resistance when design circuits. This is very valuable both in technology and economics.

After using the present invention's components and technical principles, it can acquire internal leak-free functional control and good performance of heavy load support by simple measures, while they are relatively complicated problems in traditional loops.

Therefore, according to the present invention, by using 2-way cartridge valve control subassemblies and decomposed hydraulic circuit design ways, the combined hydraulic control valve systems based on 4-way integrated control valve block bodies are a kind of simple control, reasonable, modular, configurable valve system products, which can satisfy various kinds of technical requirements. This kind of valve system products significantly simplify the entire process from design to manufacture and application, and improve the quality and decrease resources and total cost, create function and benefit which is difficult in traditional single component loops. It can reform traditional control techniques totally and on a large scale, and improve competitive ability of hydraulic drive and control technologies over other drive control technologies.

Main objects of the present invention are according to modular, configurable and open feathers in the modern control, to overall realign and replace all kinds of control circuits and combinations including the loops based on 4 ports directional control valves, by using new technical principles and product solutions, which are currently the mainstream in the field of industrial and removable equipment. The new technical principle and way have firstly used "Loop decomposition design" and "minimal fluid resistance principle" based on "hydraulic resistance theory", then used modular, configurable and open optimizing 2-way cartridge valve control assemblies, not single elements, which are called "single control hydraulic resistance", to get various kinds of combinations through simple manners, according to modular pilot control circuit combination and modular "power loop" combination (i.e., main stage combination) in decomposed hydraulic loop way FIG. 2 is a schematic of four-way hydraulic circuit which uses typical 2-way cartridge valve assemblies, called "single control hydraulic resistance". The loop is a new 4-way loop different from traditional loops. After using loop decomposition and combination principle based on "hydraulic resistance theory", when the 4-way loop and system need to be changed or improved, it can be implemented by the most simple combination way, different from the traditional loops, which will involve wide or great change of the whole process. The new technical principle has used more advanced and reasonable "integration and connection way based on installation holes". In this new principle, different functional control assemblies, which have installation and connection way meeting the same standards, include pilot control, seat valve assemblies and 2-way cartridge valve assemblies connected through insertion installation holes. Especially its power stage components, that is, seat valve assemblies and cartridge components, which are of plug-in or slide installation structure, can directly be installed to the modular, standard and general loop control valve block bodies. Obviously, this way will fundamentally change the structure formation of blocks. Based on the control structure of 2-way cartridge valve control assemblies, the loop combination principle based on "decomposition hydraulic loop design" of "hydraulic resistance theory" and new installation and connection of "the way of connection and integration based on installation holes", not only large number of changes of loop and system design can be avoided, but also overall change of the blocks of the loop can be omitted, only a few partial changes of the basic structure are made to satisfy the purpose of control change. So, the invention greatly simplifies the whole process and supply chain from design to application of hydraulic control valve loops and systems, significantly improves overall performance and quality of design and efficiency of hydraulic control valve circuits and systems, uses the sources more efficiently, saves energy and reduces time and material consuming and installation space, finally contributing to the total cost reduction. The present invention is suitable for new modes of development, production and management.

Another important object according to the present invention is through using new technical principles and product solutions, re-combine various kinds of circuits and systems, including 4-way hydraulic control valve circuits and systems, and also create and provide some new ways to satisfy control requirements which are difficult in traditional way. For example, it can get leak-free 4-way control loops just by relatively simple technical measures, and can satisfy the leak-free requirements in the implementation of the dual role of tank circuit, which is also good for loops and systems with to meet requirements of pressure-keeping, high load and movement function. If further technical measures are used, these products are also suitable for non-hydraulic oils, such as, environmental protection, anti-burning and other special types of medium, thus will be extended to these hydraulic applications besides industry and removable hydraulics. As another example, it can conveniently get differential control and flow regeneration functions just by relatively simple and low-cost way to combine the complex differential circuits with differential control and flow regeneration functions. This will be important and commonly used in control of differential diameter cylinder. In traditional way, especially in circumstances of larger sizes, the ways of loop combinations will be very complicated in order to reach the same functions, due to large number of components, resulting in increasing structures sizes, increasing weight and cost.

Another important objective according to the present invention is to use the modular connection way of hydraulic integrated control valve blocks which is different from traditional ways.

Firstly, the structure is essentially modularly integrated. For example, in the control of multiple executive structures and meet their requirement for large scale integrations and combinations, the present invention can satisfy modular and integration connection requirements of many hydraulic control loops by use of modular combinations, such as, integration connections of the same sizes and different sizes, horizontal connection integrations, vertical stack integrations or horizontal and vertical integration mixture. This will be good for modular integration of larger, more complex control systems and provide overall solutions, which is very rare in the traditional circuits.

Secondly, it is fundamental structure of overall combinations and integrations based on various kinds of single integration control systems including 4-way loops. For example, for single pump power and alone execution oil cylinders, motors, etc., with complex control needs and special control requirements, it can combine a series of monolithic control structures by a little variations and partial addition based on the fundamental control blocks, which are similar to traditional control, to implement complex control on the oil cylinders and motors. FIG. 12 is top view of FIG. 10. The integrated valve block system consists of combined input integrated control valve block systems, combined 3-way integrated control valve block systems, combined 4-way integrated control valve block systems and combined additional functional terminal valve blocks.

The way in the present invention can simply acquire a wide range and various types of large-scale integration or combination, then fully solve the problems in the traditional loops, which can not have reasonable, compact, low-cost connections and integrations based on installation surfaces, range from 10 to 32 mm, therefore the present invention has obvious advantage of technique and economics. For many complex and large hydraulic control systems, the combined hydraulic integration control valve block systems according to the present invention can simply and flexibly acquire large scale integration control and assembly of valves, loops and systems. In the application of large scale hydraulic drive and control systems, such as metallurgy or automobile processing equipment, it is helpful in implementation of overall solutions for control loops and systems, and the quality, reasonable use of resources, reduction of material and waste and energy consumption can be achieved. According to the present invention, the integrated circuit control blocks based on installation holes, not only are much smaller and lighter than the traditional loop control blocks, but also have much more less processing than traditional components and control blocks after use of forging materials, and obvious reduction of metal chips. Therefore, the invention is helpful in reduction of overall costs and can meet modular and integrated principles in modern industry and mobile equipment, reduce consumption of material and energy, provide greater support for advanced manufacturing and production and is fit for remanufacturing principles and green manufacturing principles.

In the present invention for special environment and requirements, such as anti-explosions, fire resistance, corrosion resistance and other special requirements, it can satisfy the requirements by using the appropriate technical measures, which are not complicated.

According to the present invention, the combined hydraulic integration control valve block systems are not only widely used in switching-type hydraulic control and integrations, but also used in the application of intelligent and precisely and rapidly control electro-hydraulic proportional control after using pilot control assemblies with proportional control and measure functions, then can create new type of electro-hydraulic proportional control products and integrations.

The invention has been described in great detail in the foregoing specification, and it is believed that various alterations and modifications of the invention will become apparent to those skilled in the art from reading and understanding of the specification. It is intended that all such alterations and modifications are covered in the invention, which fall into within the scope of the appended claims.

What is claimed is:

1. A combined hydraulic integrated control valve block system, comprising:

pilot control valve groups;

control valve assemblies; and a valve block body which is used to install the pilot control valve groups and the control valve assemblies, and to connect external components, wherein the pilot control valve groups consist of multiple pilot control valves, the control valve assemblies consist of 2 or more 2-way cartridge control assemblies, an installation surface for the pilot control valves on the valve block body conforms to standards, and the valve block body is a polyhedral casting based on a cuboid shape and has four main channels, P, T, A and B, and multiple pilot control channels, and at least one external installation surface and at least one internal installation surface, wherein the pilot control valve groups include two pilot control valves, the control valve assemblies consist of two 2-way cartridge control assemblies, and the pilot control valves are installed on the standard installation surfaces of flanged control cover plates of the 2-way cartridge control assemblies, and wherein top and front finishing installation surfaces of the valve block body are used to install the flanged control cover plates of the 2-way cartridge control assemblies, a right installation surface of the valve block body is provided a main channels input port P, low-pressure output port T, control channels ports Pc, Tc and connected holes used to install bolts and for pilot control, bottom or left installation surfaces of the valve block body are provided for arrangement of the main channels high-pressure input port, the low-pressure output port T, the connected holes and the control channels for pilot control assemblies.

2. Combined hydraulic integrated control valve block system according to claim 1, wherein the integrated control valve block system is a 4-way integrated control valve block system consisting of the pilot control valve groups and four 2-way cartridge control subassemblies, the valve block body and the components used for connection external and internal portions includes four main channels which are high-pressure input port P, low-pressure output port T and high-pressure output ports A and B, multiple pilot control channels, multiple internal installation surfaces and at least one external installation surface.

3. Combined hydraulic integrated control valve block system according to claim 2, wherein the 4-way integrated control valve block system is a horizontally integrated 4-way integrated control valve block system that includes two external installation surfaces.

4. Combined hydraulic integrated control valve block system according to claim 2, wherein the 4-way integrated control valve block system is a vertically integrated 4-way integrated control valve block system that includes one external installation surface.

5. Combined hydraulic integrated control valve block system according to claim 3, wherein the valve block body in the 4-way integrated control valve block system is a polyhedral casting based on cuboid which uses high strength and high performance of black metal or nonferrous metal to machining after casting, an installation boss is arranged on the front and the top surface of the valve block body, the boss comprises protruding stepped surfaces consisting of two finishing installation surfaces, the protruding installation surfaces of the boss are used to install two pilot control valve groups, and a flat surface in parallel with the boss is used to install two flanged control cover plates of the 2-way cartridge control subassemblies.

6. Combined hydraulic integrated control valve block system according to claim 5, wherein a front finishing installation surface is used for installation of two control assemblies.

7. Combined hydraulic integrated control valve block system according to claim 5, wherein on the left and right finishing installation surfaces of the valve block body are the main channels high-pressure input port P and low-pressure output port T, control channels ports Pc and Tc and connected holes used for installation bolts, said left and right finishing installation surfaces of the valve block body and the two finishing installation surfaces which are parallel to each other on the installation boss of the valve block body are all internal installation surfaces.

8. Combined hydraulic integrated control valve block system according to claim 5, wherein the bottom and back surfaces of the valve block body, which are both external installation surfaces, are used to connect installation surfaces for the main channel high-pressure output ports A and B, or assistant installation surfaces.

9. Combined hydraulic integrated control valve block system according to claim 4, wherein the valve block body in the 4-way integrated control valve block system is a polyhedral casting based on cuboid, an installation boss is arranged on the front or the top surface of the valve block body, and the protruding installation surface of the boss is used to install two pilot control valve groups.

10. Combined hydraulic integrated control valve block system according to claim 9, wherein the left and the right finishing installation surfaces of the valve block body are used to install 2 or more flanged control cover plates of 2-way cartridge control assemblies.

11. Combined hydraulic integrated control valve block system according to claim 9, wherein on the top and bottom finishing installation surfaces of the valve block body are the main channels high-pressure input port P and low-pressure output port T, control channels ports Pc and To and connected holes which are used to install bolts.

12. Combined hydraulic integrated control valve block system according to claim 9, wherein the back surface of the valve block body, which is an external installation surface, includes main channels high-pressure output ports A and B that are used for connected installation surfaces or other functions.

13. Combined hydraulic integrated control valve block system according to claim 2, wherein the 4-way integrated control valve block system can be a single 4-way integration control valve block system.

14. Combined hydraulic integrated control valve block system according to claim 2, wherein the valve block body in the single 4-way integrated control valve block system is a polyhedral casting based on cuboid, an installation boss is arranged on the front or the top surface of the valve block body, the boss comprises stepped surfaces which are two finishing installation surfaces parallel to each other, the protruding finishing installation surfaces of the boss are used to install two pilot control valve groups, the flat surface of the boss is used to install two flanged control cover plates of the 2-way cartridge control assembly.

15. Combined hydraulic integrated control valve block system according to claim 13, wherein the single 4-way integrated control valve block system is a vertically integrated 4-way integrated control valve block system, which has at least one external installation surface.

16. Combined hydraulic integrated control valve block system according to claim 15, wherein the valve block body in the 4-way integrated control valve block system is a polyhedral casting based on cuboid, and wherein an installation boss is arranged on a front or surface of the valve block body, the protruding installation surface of the boss is used to install two pilot control valve groups, the left and the right installation surfaces of the valve block body are used to install two flanged control cover plates of 2-way cartridge control assembly respectively, the bottom surface of the valve block body is used for arrangement of the main channel high-pressure input port P, low-pressure output port T and connection holes for pilot control assemblies and the back surface of the valve block body being used for arranging of connection holes of the main channels high-pressure output ports A and B or other installation connections.

17. Combined hydraulic integrated control valve block system according to claim 14, wherein the valve block body is made of a forging or profile materials, and the channels and the surfaces are all processed by machine.

18. Combined hydraulic integrated control valve block system according to claim 15, wherein the valve block body is made of a forging or profiles materials, and the channels and the surfaces are processed by machine.

19. Combined hydraulic integrated control valve block system according to claim 1, wherein 3-way integrated control valve block system, consisting of pilot control valve groups, two 2-way cartridge control subassemblies, a valve block body and the components for connection between external and internal portions, has three main channels high-pressure input port P, low-pressure input port T, high-pressure output ports A and B, multiple pilot control channels, multiple internal installation surfaces and at least one external installation surface.

20. Combined hydraulic integrated control valve block system according to claim 19, wherein the 3-way integrated control valve block system is a horizontally integrated 3-way integrated control valve block system having two external installation surfaces.

21. Combined hydraulic integrated control valve block system according to claim 19, wherein the 3-way integrated control valve block system is a vertically integrated 3-way integrated control valve block system, which has one external installation surface.

22. Combined hydraulic integrated control valve block system according to claim 20, wherein on the left and the right installation surface of the valve block body are the main channel high-pressure input port P and low-pressure input port T, control channels ports Pc and Xc and connected holes used to install bolts.

23. Combined hydraulic integrated control valve block system according to claim 21, wherein on the left and right installation surfaces of the valve block body are used for arrangement of the main channels high-pressure input port P and low-pressure input port T, control channels ports Pc and Xc and connection holes used to install bolts.

* * * * *